US005651262A

United States Patent [19]

Pendergast

[11] Patent Number: 5,651,262

[45] Date of Patent: Jul. 29, 1997

[54] HUMIDIFIED CIGAR SHOWCASE

[75] Inventor: James C. Pendergast, Racine, Wis.

[73] Assignee: J. C. Pendergast, Inc., Racine, Wis.

[21] Appl. No.: 559,710

[22] Filed: Nov. 15, 1995

Related U.S. Application Data

[63] Continuation-in-part of Ser. No. 343,221, Nov. 22, 1994, abandoned.

[51] Int. Cl.[6] ..... A47F 3/04

[52] U.S. Cl. ..... 62/176.4; 62/247; 62/255; 236/44 A

[58] Field of Search ..... 236/44 R, 44 A; 62/247, 255, 176.4; 454/60

[56] References Cited

U.S. PATENT DOCUMENTS

| | | | |
|---|---|---|---|
| 2,222,236 | 11/1940 | Philipp | 236/44 R |
| 2,639,958 | 5/1953 | Stephenson | 312/31 |
| 3,366,432 | 1/1968 | Carmer | 62/255 |
| 3,424,231 | 1/1969 | Truhan | 236/44 R |
| 3,769,805 | 11/1973 | Corini | 62/255 |

*Primary Examiner*—William E. Tapolcai
*Attorney, Agent, or Firm*—Hill, Steadman & Simpson

[57] ABSTRACT

A humidified cigar showcase is provided having a closed cabinet defining an interior with a plurality of partitions such as shelves or drawers. Moist air is supplied to one side of the interior through a supply plenum and withdrawn from an opposite side through a return plenum, creating a horizontal humid airflow through channels defined between the partitions. The plenums are arranged in a rear wall of the showcase to have an inconspicuous profile and so that the showcase interior may be viewed through windowed side panels. The humidity is maintained with a humidistat which controls a fan. The fan drives the airflow, withdrawing moisture from a water reservoir and delivering the humid airflow through the plenums. Baffles may be provided in the plenums to vent airflow more uniformly along the plenums.

21 Claims, 4 Drawing Sheets

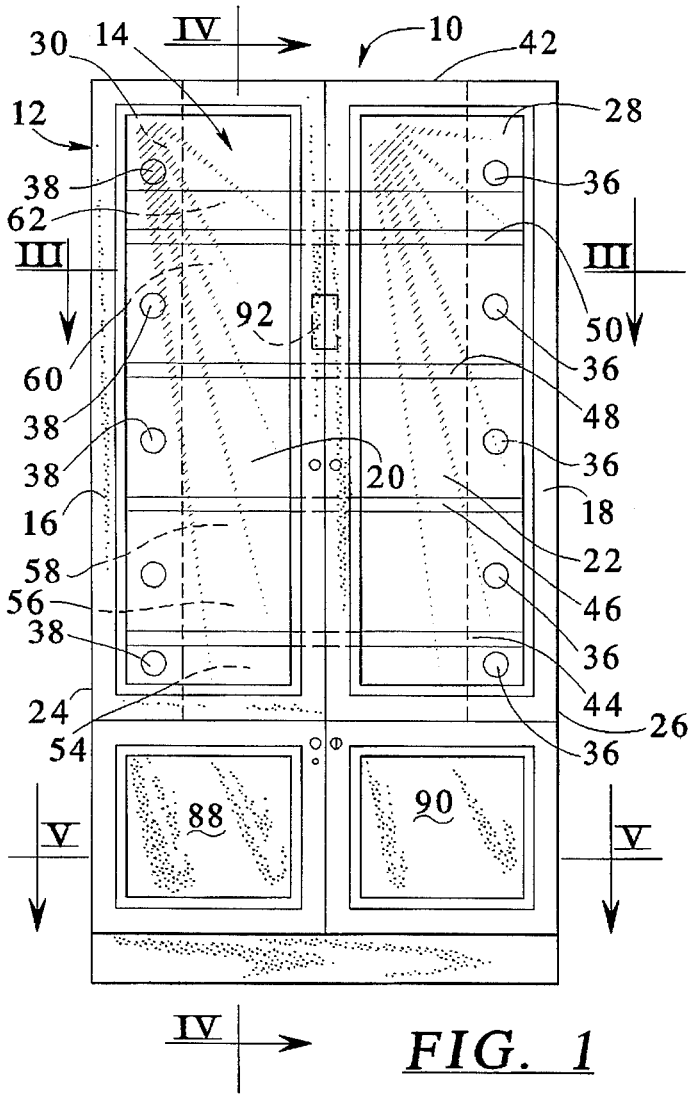
FIG. 1
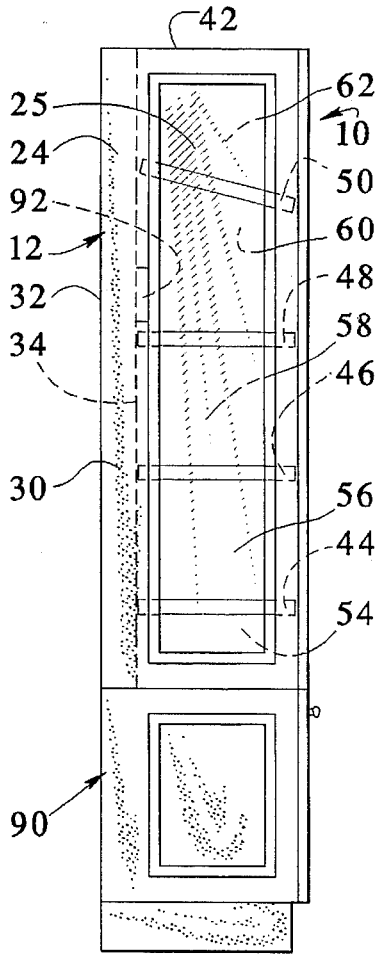
FIG. 2
FIG. 3
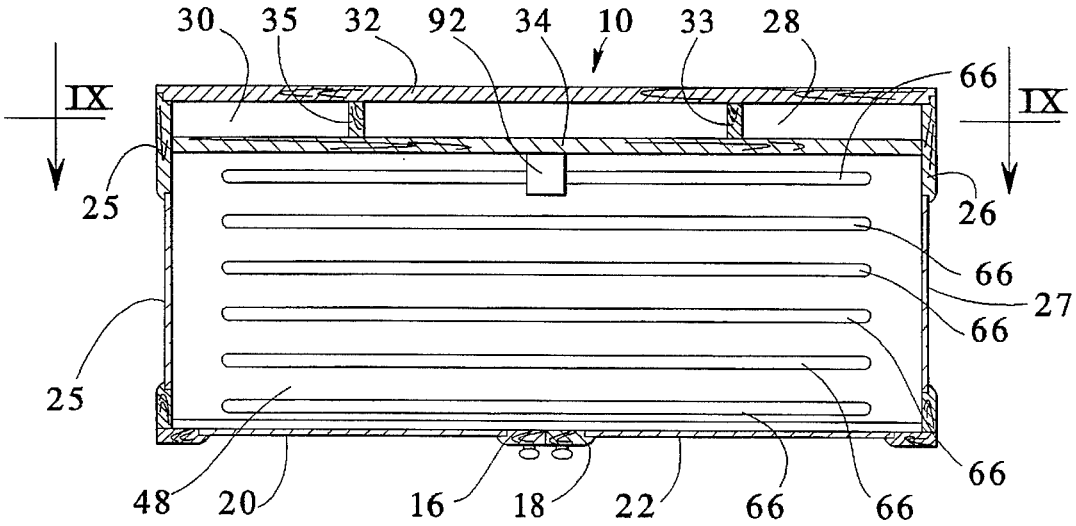

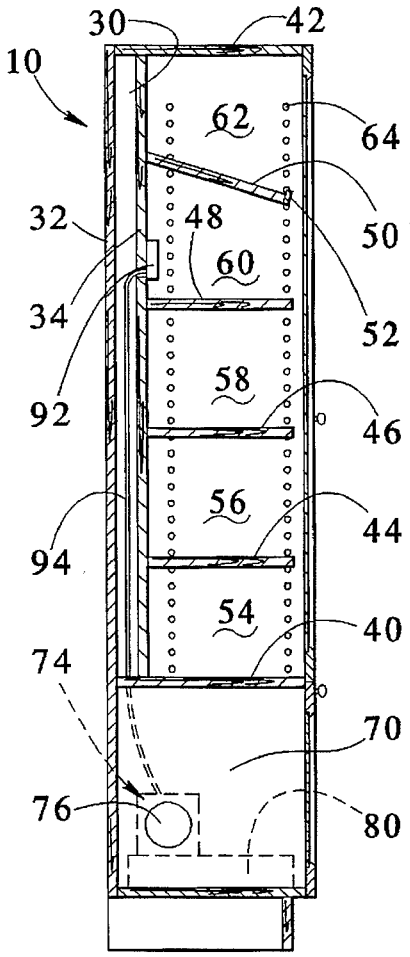
FIG. 4
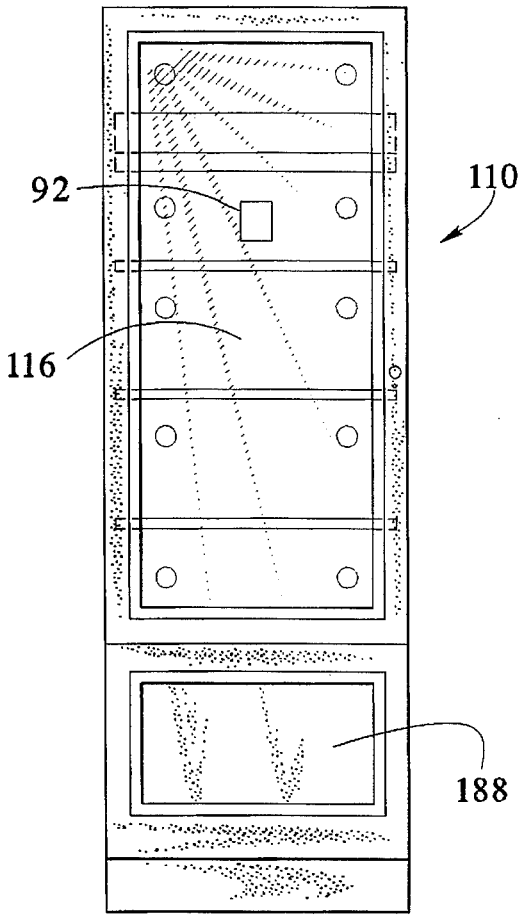
FIG. 6
FIG. 5
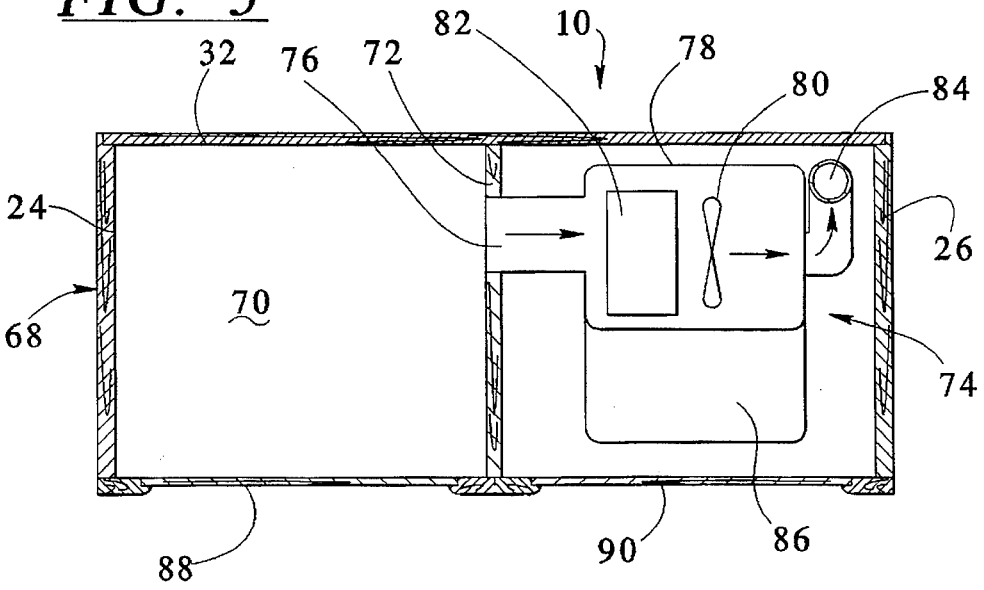

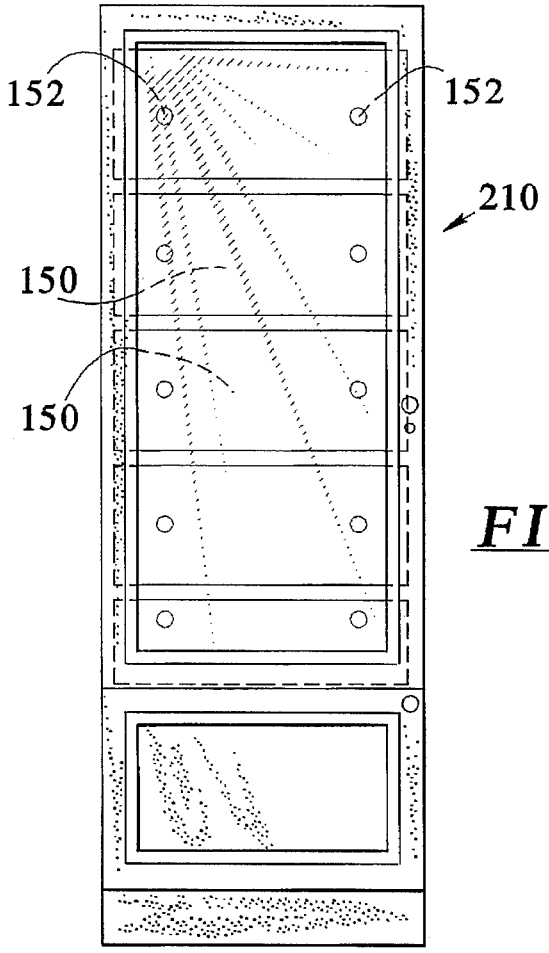
FIG. 7
FIG. 8
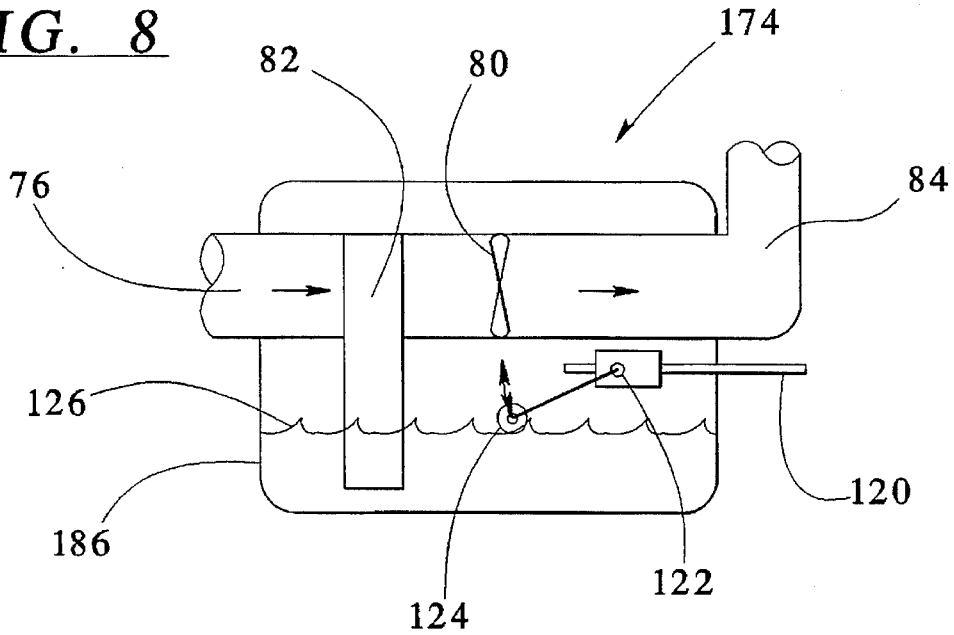

HUMIDIFIED CIGAR SHOWCASE

CROSS REFERENCE TO RELATED APPLICATION

This application is a continuation-in-part of my prior application Ser. No. 08/343,221, filed Nov. 22, 1994, now abandoned.

BACKGROUND OF THE INVENTION

The present invention generally relates to humidified showcases. More particularly, the present invention relates to a humidified showcase for cigars. Humidified cigar storage cases are generally known. Proper cigar storage requires a humid atmosphere. Otherwise, cigars tend to dry out, losing quality. A dry, improperly stored cigar can have a harsh taste and exhibit undesirable burning characteristics. Therefore, humidified cigar storage cases, also known as "humidors," have been designed to provide a humid atmosphere to surround stored cigars.

In addition to storing cigars at a proper humidity, a cigar case desirably provides a means of displaying stored cigars. Attractive displaying is particularly important for retail sale of properly stored cigars, such as in tobacco shops. However, it is also desirable to display fine cigars at home while maintaining them in a controlled climate. For example, U.S. Pat. Nos. 2,639,958 and 2,735,739 relate to humidified cigar showcases. Also, U.S. Pat. No. 4,062,983 relates to a device for maintaining food temperature and moisture with a circulating vortex of air.

A need exists for a humidified cigar showcase which has reliable humidity control with a modern control system and which provides improved circulation. Furthermore, a need exists for a cigar showcase configured to display cigars with high visibility and easy access. Moreover, it is desirable to provide a cigar showcase having controlled-airflow duct work arranged to not impede visibility of the showcase interior through front or side glass panels.

SUMMARY OF THE INVENTION

The present invention provides a humidified cigar showcase which provides improved humidifying and attractive display of cigars. To this end, a showcase is provided having a closed cabinet with a rear wall formed of an exterior panel and a parallel, spaced interior panel. Disposed in the rear wall between the interior and exterior panels are a supply air plenum and return air plenum. Each plenum communicates with the cabinet interior through one or more vents. The positioning of the plenums within the rear wall provides a thin plenum profile relative to the overall depth of the cabinet. This advantageously allows the interior to have a full display width between side panels and, in a preferred embodiment, further allows viewing of the interior through windows in the side panels.

Preferably, the rear wall-defined return and supply plenums are arranged vertically at opposite sides of the cabinet. A plurality of shelves are provided, each shelf being disposed generally horizontally across an interior of the cabinet. The shelves define a plurality of generally horizontal circulation channels across an interior of the cabinet from the supply air plenum to the return air plenum. One or more of the shelves may be slotted to provide communication between adjacent channels. A fan drives an airflow from the return air plenum to the supply air plenum. A water reservoir or a supply water line with an automatic water level switch provides moisture to the airflow between the return air plenum and the supply air plenum.

Other features may include a humidistat disposed in the interior to control the fan, maintaining a set humidity level within the cabinet, and a filter element disposed in the airflow upstream of the fan to provide evaporative humidification.

Preferably, the fan and said water reservoir are mounted in a lower portion of the cabinet. In another embodiment, however the humidification system can be located in an upper portion of the cabinet.

The water reservoir may be removable and, in an automatic filling embodiment, a switching valve may be actuated by a float device responsive to the water level.

One or more doors are provided to access the interior. Each door may have a transparent window for displaying the interior.

In an embodiment, a defined area of the return plenum acts as a storage area. The storage area is disposed in a lower portion of the cabinet, and can be boxlike or columnar.

An advantage of the present invention is to provide a humidified cigar showcase having a wide interior for display through windows.

A related advantage of the present invention is to provide a humidified cigar showcase having side panels which are substantially not overlapping circulation ducts so that display windows in the side panels permit viewing directly into the showcase interior.

Additional features and advantages of the present invention are described in, and will be apparent from, the detailed description of the presently preferred embodiments and from the drawings.

BRIEF DESCRIPTION OF THE DRAWINGS

FIG. 1 illustrates a front elevation of a humidified showcase according to the present invention.

FIG. 2 illustrates a side elevation of the humidified showcase of FIG. 1.

FIG. 3 illustrates a sectional top plan view taken generally along line III—III of FIG. 1.

FIG. 4 illustrates sectional side view taken generally along line IV—IV of FIG. 1.

FIG. 5 illustrates a sectional top plan view taken generally along line V—V of FIG. 1.

FIG. 6 illustrates a front elevation of a humidified showcase according to the present invention having a single door.

FIG. 7 illustrates a front elevation of an embodiment partitioned by drawers.

FIG. 8 illustrates a front schematic view of an embodiment of the humidification system which automatically refills.

DETAILED DESCRIPTION OF THE PRESENTLY PREFERRED EMBODIMENTS

Figure 9:
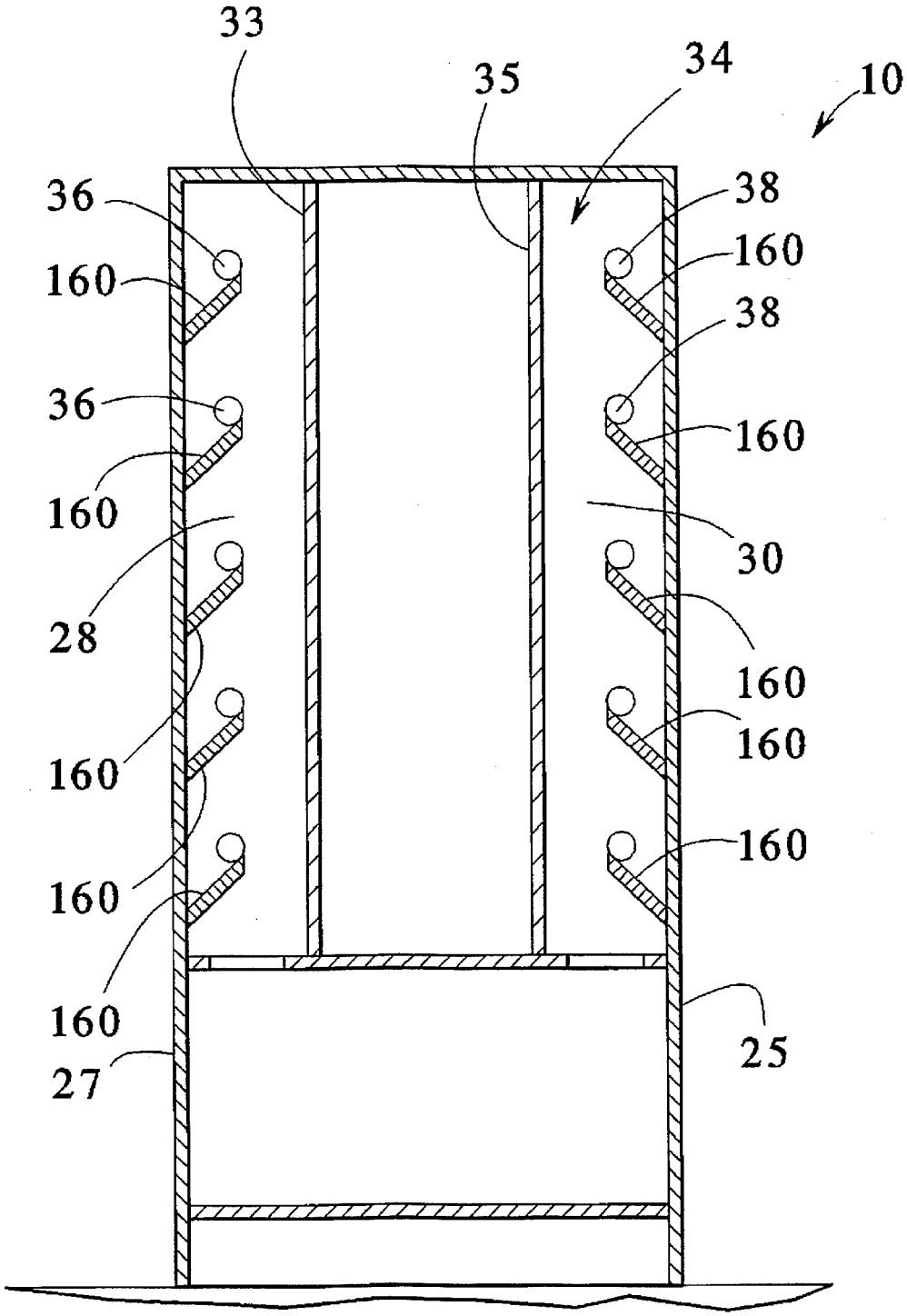
FIG. 9 illustrates a rear sectional view of the showcase of FIG. 1, taken generally along line IX—IX of FIG. 3.

As illustrated in FIG. 1, a humidified showcase 10 is provided. The showcase 10 has a cabinet 12 defining a showcase interior 14. In the embodiment of FIG. 1, the cabinet 12 has a front including a pair of front doors 16 and 18 for providing access to the interior 14. Windows 20 and 22 are provided in the doors 16 and 18, respectively, so that the interior 14 can be viewed. Also, as illustrated in FIG. 2, the cabinet 12 includes a pair of side panels 24 and 26. Windows 25 and 27 are provided in the side panels 24 and 26, respectively.

Referring to FIGS. 1, 3 and 4, a supply plenum 28 and a return plenum 30 are defined at a rear of the cabinet 12 between a rear exterior wall 32 and a rear interior wall 34. In a preferred embodiment, the rear exterior wall 32 and rear interior wall 34 are vertical and parallel to each other. A pair of plenum walls 33 and 35 extend between the interior and exterior walls 32 and 34 to separate the plenums 28 and 30. The supply plenum 28 is a duct which provides a flow of moist air to the interior 14. The return plenum 30 withdraws the flow of air from the interior 14. The supply plenum 28 is disposed vertically along the side panel 26, and the return plenum 30 is disposed vertically along the opposite side panel 24.

Turning to FIG. 1, a plurality of supply vents 36 and a plurality return vents 38 are provided in the rear interior wall 34 of the cabinet 12. The supply vents 34 permit airflow from the supply plenum 28 to the interior 14, and the return vents 38 permit airflow from the interior 14 into the return plenum 30.

As shown in FIG. 4, the interior has a planar bottom shelf 40 and a planar top panel 42. The interior 14 is a closed cavity defined by the doors 16 and 18, the side panels 24 and 26, the top panel 42, the bottom shelf 40, and the rear interior wall 34. Therefore, the interior 14 is generally sealed except for airflow through the supply vents 36 and the return vents 38. Illustrated in FIGS. 1–4, a plurality of partitions are provided such as planar adjustable shelves 44, 46, 48 and 50 arranged in the interior 14. As illustrated, the shelves 44, 46 and 48 are arranged flatly, and the top shelf 50 is arranged on an incline so that items displayed thereon can be more easily viewed. The inclined shelf 50 has a lip 52 to keep items from sliding off. However, any of the shelves 44, 46, 48, 50 can be mounted flat or on an incline in any desired arrangement as needed. Furthermore, the shelves can be configured in a box format with permanent or removable dividers to display cigars not in their original boxes. Additionally, the shelves 44, 46, 48, 50 can be configured in a tray format, having dividers like a box format shelf, but each shelf being removable as a single tray to show or refill with new cigars.

Each adjustable shelf 44, 46, 48 and 50 generally extends across the interior 14. A plurality of circulation channels 54, 56, 58, 60 and 62 are thereby defined across the interior 14 in a vertically stacked relationship between the bottom shelf 40, the adjustable shelves 44, 46, 48, 50, and the top panel 42, respectively.

FIG. 4 illustrates a plurality of mounting holes 64 in the side panel 26. The mounting holes 64 are disposed in each side panel 26, 28 at equal vertical increments so that the shelves 44, 46, 48 and 50 can be mounted on pegs and vertically adjusted as desired. Furthermore, the interior 14 is preferably dimensioned so that a variety of open cigar boxes (not shown) can be conspicuously displayed on the shelves 40, 44, 46, 48 and 50.

Alternatively to the mounting hole system, standard-and-bracket hardware or standard-and-clip hardware can be used to mount the shelves.

Referring back to FIG. 1, the supply vents 36 and return vents 38 are placed at spaced vertical distances along the rear interior wall 34 so that at least one supply vent 36 and one return vent 38 are associated with each circulation channel 54, 56, 58, 60, and 62 so that air flows generally horizontally across the interior 14 from the supply plenum 28 to the return plenum 30 through the channels 54, 56, 58, 60 and 62. The vents 36, 38 can be spaced equally as shown, or in any other arrangement. For instance a continuous, vertical, single supply vent or return vent can be provided (not shown).

In an optional embodiment, slots 66 can be provided in one or more of the adjustable shelves, as illustrated in FIG. 4. The slots 66 permit vertical airflow between the channels 54, 56, 58, 60 and 62 to increase circulation in the interior 14. Slots 66 can be provided in any shelf configuration, i.e., inclined, flat, box format, tray format, etc.

A bottom compartment 68 is defined in a lower portion of the cabinet 12, as illustrated in FIGS. 1, 2, 4, and 5. The bottom compartment 68 is located beneath the interior 14, separated therefrom by the bottom shelf 40. As shown in FIGS. 4 and 5, a storage area 70 can be provided in the bottom compartment 68. The return plenum 30 enlarges into the space defining the storage area 70. The storage area 70 is thereby humidified by the flow of return air passing therethrough. The storage area 70 can be used to store cigar boxes (not shown) that are not on display in the interior 14.

As shown in FIG. 5, the bottom compartment 68 has a central divider 72 which defines a side of the storage area 70. Opposite the storage area 70, the bottom compartment 68 houses a humidification system 74 for providing humid airflow. The airflow passes from the storage area 70 through a lower return plenum portion 76 and into a housing 78. Within the housing 78, a fan 80 is provided to draw air from the lower return plenum portion 76 through a filter 82. The fan 82 then forces the airflow through a lower supply plenum portion 84 which is in fluid communication with the supply plenum 28. The direction of the airflow is indicated by arrows. In an embodiment, the central divider 72 can be eliminated. The fan 80 still draws air from the return plenum 30.

The humidification system 74 which includes a water reservoir 86 is provided at a bottom side of the housing 78. Water is drawn and held by the filter 82. Thus, water from the reservoir 86 evaporates from the filter 82 and enters the airflow driven by the fan 80. Thus, the airflow delivered through the supply plenum 28 is humid. A pair of lower doors 88, 90 are provided for accessing the storage area 70 and the humidification system 74, respectively. Preferably, the water reservoir 86 is removable for refilling and cleaning.

The humidification system 74 is preferably sealed. However, in an embodiment, fresh air is introduced through the fan 82 to exchange an amount of the return airflow with fresh air during normal operation. Some or all of the airflow can be exchanged.

In another embodiment, as illustrated in FIG. 8, a humidification system 174 can be provided wherein a reservoir 186 is automatically refillable. A water line 120 provides a flow of water to a valve 122 actuatable by a float device 124 which is responsive to the water level 126. The float device 124 causes the valve 122 to open when the water level 126 drops below a desired amount. The float device 124 causes the valve 122 to close when the desired water level is reached.

As seen in FIG. 4, a humidistat 92 is mounted in the cabinet interior 14 on the rear interior wall 34 and senses the relative humidity. The humidistat 92 provides a signal through wiring 44 to actuate the fan 80 to modulate the circulation of moist air as needed to maintain the desired humidity level in the interior 14. Preferably, the humidistat 92 maintains a 70% humidity level which is desirable for cigar storing, although another level can be set if desired. A hygrometer and/or a thermometer can also be mounted in the interior 14 so that climate conditions can be monitored.

FIG. 6 illustrates an alternative embodiment wherein a showcase 110 has a single door 116 for accessing the interior 114, a single door 188 for accessing the lower compartment, and a narrower configuration than the embodiment of FIGS. 1–5. Otherwise, the showcase 110 is generally the same.

As illustrated in FIG. 7, in an alternative embodiment, a humidified showcase 210 has an interior partitioned by drawers 150, instead of one or all of the shelves of the previously discussed embodiments. An interior of each drawer 150 defines a generally horizontal circulation channel. The interiors of the drawers 150 are in communication with both the supply plenum 28 and the return plenum 30 so that moist air can circulate therethrough. Each drawer 150 can be pulled slidably outward by a set of grippable handles 152.

Referring now to FIG. 9, a plurality of baffles 160 may be provided in the supply plenum 28 and a plurality of baffles 162 may be provided in the return plenum 30. The baffles are configured to extend partially across the associated plenums 160, 162 in order to assist in attaining a generally uniform airflow through the vents and among the multiple circulation channels 54, 56, 58, 60 and 62. Accordingly, in the illustrated embodiment, each baffle 160 is angularly disposed partially across the supply plenum immediately upstream of one of the supply vents 36, and each baffle 162 is disposed angularly partially across the return plenum 34 immediately downstream of one of the return vents 38. Without the baffles, it has been found that the uppermost vents, i.e., the farthest from the fan, experience a greater rate of airflow than the lower ones. The baffles help keep the lower parts of the cabinet as adequately circulated as the upper parts. In possible embodiments where the plenums are short, baffles might not be needed.

It should be understood that various changes and modifications to the presently preferred embodiments described herein will be apparent to those skilled in the art. Such changes and modifications may be made without departing from the spirit and scope of the present invention and without diminishing its attendant advantages. For example, the supply plenum 23 and return plenum 30 can be disposed on sides 24 and 26, respectively reversed from that described above. Also, other baffle configurations might be possible, so long as generally uniform airflow is achieved across all portions of the cabinet interior. It is, therefore, intended that such changes and modifications be covered by the appended claims.

What is claimed is:

1. A humidified cigar display case comprising:

a closeable cabinet defining an interior;

a supply plenum at a rear of the interior providing a flow of air into said interior through a plurality of supply vents disposed in a rear of said cabinet near a first side panel of said cabinet, a plurality of baffles being secured in the supply plenum;

a return plenum at a rear of the interior withdrawing a flow of air from said interior through a plurality of return vents disposed in the rear of said cabinet near a second side panel of said cabinet opposite said supply plenum, a plurality of baffles being secured in the return plenum;

a fan disposed in a flow path between said return plenum and said supply plenum;

a water reservoir supplying moisture to said flow path;

a plurality of generally horizontal partitions arranged in said cabinet in a vertically stacked relationship, said partitions generally defining a plurality of circulation channels between adjacent partitions, each of said communication channels being adapted to contain and display cigars, each said circulation channel being in communication with said supply plenum and said return plenum so that each of the circulation channels guides a generally horizontal airflow from said supply plenum to said return plenum;

wherein said baffles are adapted to maintain a generally uniform rate of said airflow through said circulation channels.

2. The display case according to claim 1, wherein said cabinet includes a front opposite said rear, said first and second side panels extending between the front and the rear in an opposed manner, the front and side panels each having at least one window to display said interior.

3. The display case according to claim 1 further comprising:

a humidistat disposed in the interior of said cabinet to sense a humidity level within said cabinet and control said fan to maintain a set humidity level.

4. The display case according to claim 1 further comprising:

a filter disposed in said flow path, said filter drawing water from said reservoir to provide moisture to said flow path.

5. The display case according to claim 1 further comprising:

at least one hinged door providing access to said partitions; and a window in each said door.

6. The display case according to claim 1 wherein said cabinet includes a bottom compartment, said compartment housing said fan and said water reservoir.

7. The display case according to claim 1 wherein said return and supply plenums are substantially vertically disposed.

8. The display case according to claim 1 wherein at least one of said partitions is a shelf.

9. The display case according to claim 8 wherein said shelf is slotted to provide flow communication between adjacent circulation channels.

10. The display case according to claim 1 wherein an amount of fresh air is exchanged with air in said flow path.

11. A humidified cigar showcase comprising:

a closed cabinet having a rear wall including an exterior rear wall and an interior rear wall;

a vertical supply air plenum disposed between the interior and exterior rear walls of said cabinet generally at a first side, said supply air plenum being in communication with an interior of said cabinet, a plurality of baffles being secured within said supply air plenum;

a vertical return air plenum disposed between the interior and exterior rear walls of said cabinet at generally an opposite side of said supply air plenum, a plurality of baffles being secured within said return air plenum;

said return air plenum being in communication with said interior;

a plurality of partitions, each of said partitions being disposed generally horizontally across an interior of said cabinet, said partitions defining a plurality of generally horizontal circulation channels across an interior of said cabinet from said supply air plenum to said return air plenum;

a fan driving an airflow from said return air plenum to said supply air plenum, said circulation channels being adapted to contain cigars, and said baffles being adapted to maintain a uniform rate of said airflow generally uniformly among said circulation channels;

a water reservoir;

a filter to draw water form said reservoir to provide moisture to said airflow between said return air plenum and said supply air plenum; and a humidistat disposed in said interior and controlling said fan to maintain a set humidity level within said cabinet.

12. The humidified cigar showcase according to claim 11 wherein said fan and said water reservoir are mounted in a lower portion of said cabinet.

13. The humidified cigar showcase according to claim 11 wherein said water reservoir is removable.

14. The humidified cigar showcase according to claim 11 further comprising a door openable to provide access to said interior.

15. The humidified cigar showcase according to claim 11 further comprising a pair of doors arranged in a side-by-side arrangement to access said interior.

16. The humidified cigar showcase according to claim 11 wherein at least one of said partitions is a shelf.

17. The humidified cigar showcase according to claim 11 further comprising an enlargement of said return plenum defining a storage area.

18. The humidified cigar showcase according to claim 17 wherein said storage area is disposed in a lower portion of said cabinet.

19. The humidified cigar showcase according to claim 11 wherein at least one of said partitions includes one or more drawers.

20. The humidified cigar showcase according to claim 11 further comprising:

a valve to provide water from a water line into said water reservoir; and a float device to operate said valve in response to a water level in said reservoir to automatically fill said reservoir.

21. The humidified cigar showcase according to claim 11, further comprising:

a pair of opposed side panels arranged generally perpendicularly to said rear wall, each said side panel having at least one window displaying the interior.

* * * * *